US010435928B2

(12) United States Patent
Workman

(10) Patent No.: US 10,435,928 B2
(45) Date of Patent: Oct. 8, 2019

(54) PORTABLE DOOR SECUREMENT DEVICE

(71) Applicant: David Workman, Carlsbad, CA (US)

(72) Inventor: David Workman, Carlsbad, CA (US)

( * ) Notice: Subject to any disclaimer, the term of this patent is extended or adjusted under 35 U.S.C. 154(b) by 0 days.

(21) Appl. No.: 15/479,661

(22) Filed: Apr. 5, 2017

(65) Prior Publication Data

US 2019/0010743 A1 Jan. 10, 2019

Related U.S. Application Data

(63) Continuation-in-part of application No. 29/596,119, filed on Mar. 15, 2017, now Pat. No. Des. 823,664.

(51) Int. Cl.

| | |
|---|---|
| ***E05C 19/00*** | (2006.01) |
| ***E05C 17/54*** | (2006.01) |
| ***E05C 17/64*** | (2006.01) |
| ***E05C 17/44*** | (2006.01) |
| ***E05C 17/04*** | (2006.01) |

(52) U.S. Cl.

CPC ..... *E05C 19/004* (2013.01); *E05C 17/54* (2013.01); *E05C 17/047* (2013.01); *E05C 17/44* (2013.01); *E05C 17/443* (2013.01); *E05C 17/446* (2013.01); *E05C 17/64* (2013.01); *Y10T 292/34* (2015.04); *Y10T 292/37* (2015.04); *Y10T 292/373* (2015.04); *Y10T 292/65* (2015.04); *Y10T 292/67* (2015.04); *Y10T 292/68* (2015.04); *Y10T 292/71* (2015.04); *Y10T 292/73* (2015.04)

(58) Field of Classification Search

CPC ..... E05C 17/64; E05C 17/54; E05C 17/446; E05C 17/443; E05C 17/44; E05C 17/047; Y10T 292/65; Y10T 292/67; Y10T 292/34; Y10T 292/37; Y10T 292/373; Y10T 292/68; Y10T 292/71; Y10T 292/73

USPC ..... 292/288, 289, 290, 340, 339, 342, 343, 292/338, 259 R, DIG. 15; 16/82, 85, 16/86 B

See application file for complete search history.

(56) References Cited

U.S. PATENT DOCUMENTS 598,405 A * 2/1898 Williams ..... E05C 19/004 292/339
2,870,281 A * 1/1959 Mitchell ..... H01H 3/161 116/85
3,124,382 A * 3/1964 Strother ..... E05C 19/004 292/343
3,583,743 A * 6/1971 Newell ..... E05C 19/004 248/354.1
4,019,765 A * 4/1977 Nichola ..... E05C 19/004 248/354.4
4,157,128 A * 6/1979 Peters ..... E05D 11/1007 16/352
4,483,558 A * 11/1984 Van Meter ..... E05C 19/004 292/339
4,563,027 A * 1/1986 Chechovsky ..... E05C 19/004 292/339

(Continued)

*Primary Examiner* — Kristina R Fulton
*Assistant Examiner* — Faria F Ahmad
(74) *Attorney, Agent, or Firm* — Donn K. Harms

(57) ABSTRACT

A portable door securement device is provided having a member extending from a first end engaged to a doorknob of a door to a second end engaged with a floor adjacent the door, to prevent opening of the door in a direction toward the engaged member. A slot at a first end of the member engages around a stem of the door handle thereby preventing disengagement of the member from the door, and preventing opening of the door.

20 Claims, 3 Drawing Sheets

(56) References Cited

U.S. PATENT DOCUMENTS 4,607,253 A * 8/1986 Wooten ..... E05C 19/004 200/61.93
4,819,296 A * 4/1989 Wilkins ..... E05C 19/004 16/293
4,971,374 A * 11/1990 Lovell ..... E05C 21/00 206/231
5,040,835 A * 8/1991 Barker ..... E05C 19/004 292/338
5,064,232 A * 11/1991 Quarberg ..... E05C 19/004 292/339
5,131,701 A * 7/1992 Stepniewski ..... E05B 65/0888 254/39
5,135,273 A * 8/1992 MacCalder ..... E05C 19/004 292/338
5,333,922 A * 8/1994 Jones ..... E05C 19/004 292/339
5,340,175 A * 8/1994 Wood ..... E05C 19/004 292/339
5,618,072 A * 4/1997 Pitchford ..... E05C 19/004 292/339
5,787,548 A * 8/1998 Tzen ..... A01G 17/10 16/82
5,988,710 A * 11/1999 Kortschot ..... E05C 19/004 292/272
6,513,778 B2 * 2/2003 Hefley ..... A62B 3/005 248/351
6,557,915 B1 * 5/2003 Duff ..... E05C 17/54 292/343
7,030,758 B1 * 4/2006 Markegard ..... E05C 19/004 292/338
7,137,655 B2 * 11/2006 Quarberg ..... E05C 19/004 292/339
7,164,356 B1 * 1/2007 Zeitz ..... G08B 13/08 292/338
D583,268 S * 12/2008 Chan ..... D10/106.1
8,075,028 B1 * 12/2011 Porter ..... E05C 17/047 16/82
2002/0093209 A1 * 7/2002 Gerchow ..... E05B 65/0888 292/339
2004/0070217 A1 * 4/2004 Demlow ..... E05C 17/443 292/339
2012/0279538 A1 * 11/2012 Chen ..... A45B 3/00 135/66
2013/0318882 A1 * 12/2013 Booker ..... E05C 17/54 49/506
2014/0035299 A1 * 2/2014 Lee ..... E05C 19/188 292/288
2014/0353988 A1 * 12/2014 Al Kayali ..... E05C 19/004 292/339
2014/0375070 A1 * 12/2014 Hatton ..... E05C 17/443 292/339
2015/0054296 A1 * 2/2015 Kaplafka, Jr. ..... E05C 19/18 292/343

* cited by examiner

PORTABLE DOOR SECUREMENT DEVICE

FIELD OF THE INVENTION

The present device relates to the securing of doors providing entry to a room. More particularly, the disclosed device and method relate to a portable door-engageable device, configured to removably engage with any door having a handle, and prevent opening of the secured door until the device is removed from engagement thereto.

BACKGROUND OF THE INVENTION

The securing of doors against unwanted entry has been a problem as long as there have been doors. Less than honest people are always trying to gain entry to rooms for which they are not authorized. This can lead to criminal activity such as breaking and entering, burglary, or other crimes concerning property and theft. More importantly, unauthorized entry by ill-doers can lead to crimes involving the person and safety of the occupant of the room or building. Consequently, many individuals have become seriously concerned about their personal safety and security.

Such concerns are significantly increased where a person is temporarily occupying a room such as a hotel or motel room. While in their home, they can install multiple locks and alarms, in a hotel or motel, they can only employ the locks provided them, by the establishment, to secure the door to their room or suite. Generally, such locks are electronic or mechanical, but suffer from a significant shortfall in that many employees have pass keys to the room, and it is not unknown that criminals have found codes and devices that will circumvent a locked door and allow them into a room or suite.

As such, there is an unmet need for a portable locking device for securing doors from unauthorized opening to prevent entry into homes, businesses, and especially into hotel rooms and suites. Such a device should be easy to secure to any door, yet provide significant if not total prevention of opening of a secured door, unless disengaged. Such a device should be easily deployed and engaged by a user, but once so engaged should be tamper proof and unremovable by anyone but occupants of the secured room.

Because of the more significant security concerns of users who travel, due to their reliance on the security of the doors and rooms of a hotel or motel, such a device should be configured for easy transport. To that end, such a door securement device should be lightweight so as to not add excess weight to luggage and should be collapsible to a configuration which will easily fit in a conventional suitcase. From this collapsed or stored configuration, such a device must also be easily deployed and engaged to the knob stem of the doors of choice without the need for tools or fasteners or other damaging connections to the door.

In this fashion, upon the arrival of a user at a destination, the device is easily deployed to provide security from unauthorized entry through the door to which it engages, whether the door opener has a knob or handle connected to the stem controlling the lock. Still further, such a device should be easily and quickly disengageable to allow entry for authorized visitors or to allow the exit of the user from the room, especially if there is an emergency.

The forgoing examples of related art of door securement and security and limitations related therewith are intended to be illustrative and not exclusive, and they do not imply any limitations on the invention described and claimed herein. Various other limitations of the related art are known or will become apparent to those skilled in the art upon a reading and understanding of the specification below and the accompanying drawings.

SUMMARY OF THE INVENTION

The device and system herein disclosed and described provides a solution to the shortcomings in prior art and achieves the above noted objects through the provision of a door securing device which once engaged, prevents unauthorized entry through the door to which it engages.

The device features a securing pole or member which may be a static length, but is preferably adjustable in length. In an adjustable mode of the securing member, a telescopically adjustable member is formed by a first portion slidably engaged to a second portion of the formed telescopic member. This telescopic engagement thereby allows for an adjustment of the length of the member between a first end and second end thereof of the member.

In all modes of the device, a first end of the member is configured to connect in a surrounding engagement around a door handle stem which conventionally connects a handle or knob thereon, to the door mechanism. Conventionally, rotation of this stem by moving a knob or handle connected to the stem, actuates the door mechanism to release from the adjacent door jamb and allow an opening of the door.

A current preferred mode of adapting the first end of the telescopic or static member for such a surrounding engagement is the positioning of a connector body at the first end of the member. The body of the engaged connector has a slot or U-shaped configuration at a first end of the connector body, forming a gap running between two opposing sides of the connector body at the first end. This gap is sized to allow the stem of the handle or knob to slide therein, and position it in-between the two opposing sides of the slot at the first end of the body of the connector.

In a particularly preferred mode of the device herein, the body of the connector is pivotally engaged at a mid portion of the body, with the first end of the telescopic member or member. At a second end of the connector body, opposite the slotted end, is located a handle portion of the connector body. This handle portion is moveable from a first position, spaced a first distance from the member, to a second position closer to and adjacent the member, using a pivoting engagement of the mid portion of the connector with the telescopic member.

During engagement of the device with a door, the door knob stem is slid into the gap at the first end of the connector body. The second end of the member is secured against the floor a distance from the base of the door. The member so positioned preferably projects at a downward angle away from the door surface such that the second end of the member is operatively positioned upon the floor a distance away from the door surface.

The handle at the second end of the body of the connector, in this configuration projects away from the member, is particularly preferred in all modes of the device. This is because if the user wishes to release the U-shaped connector and member quickly from an engaged position, a rotation of the handle in a direction away from the member, will cause such a quick disconnection. A reverse movement of the handle toward the member can also be used to compress and engage the connector tightly against the stem of the handle or knob.

As noted, the second end of the member is adapted for a frictional stationary position and connection against the floor or supporting surface, spaced a distance from the door, be it carpet, hardwood, or other material. Currently, a base is engaged with the second end of the member. This base has a contact surface adapted to frictionally engage the floor and prevent sliding thereon. The contact surface is preferably rubber or a polymeric material having a shore and surface adapted to enhance frictional engagement.

As noted, while in a simple mode the member may be a single piece of static length, the member is preferably telescopic and collapsible to a compact position for stowing the device in the confines of luggage or such to allow for easy transport. Positioning of the member when telescopically formed from at least two segments, allows the user to translate the segments to form the member to a determined length. Thereafter fixing this length can be accomplished by insertion by locking the two segments, such as with a pin which communicates through the sidewalls of both segments of the member in this sliding engagement. Locking the two segments will hold them to achieve a particular length of the member for use. If the lock is formed by a pin, it preferably has a quick release ring upon it, to provide a second means to quickly and easily disengaged the device from a secured door, such as in an emergency where a quick exit from the room may be desirable.

The device so configured with a first end adapted to engage around any door mechanism stem, and a fixed or preferably adjustable length member having a second end adapted to frictionally engage a floor surface, is thus easily stowed in a compact configuration, easily engaged to secure any door configured to open in a direction toward the device where a stem of the handle is operatively engaged.

With respect to the above description, before explaining at least one preferred embodiment of the herein disclosed door securement invention in detail, it is to be understood that the invention is not limited in its application to the details of construction and to the arrangement of the components in the following description or illustrated in the drawings. The door securing invention herein described and shown is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other door securing structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the present invention to provide a lightweight and highly portable door securing device.

It is an additional object of this invention to provide such a door securing device which requires no tools, fasteners, or other engagement components which would damage the door being secured.

It is yet another object of the invention herein, to provide a door securing device which is easily collapsed to a stored configuration sized for transport in a suitcase.

It is another object of the present invention to provide such a door securement device, which is quickly and easily engageable to a door of choice from the stored and collapsed position to encourage use.

Still further it is an object of this invention to provide a simple but secure door locking device, which is tamper proof by both hotel and motel staff as well as criminals.

These and other objects, features, and advantages of the present door securing invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed device. It is intended that the embodiments and figures disclosed herein are to be considered illustrative of the invention herein, rather than limiting in any fashion.

Figure 2:
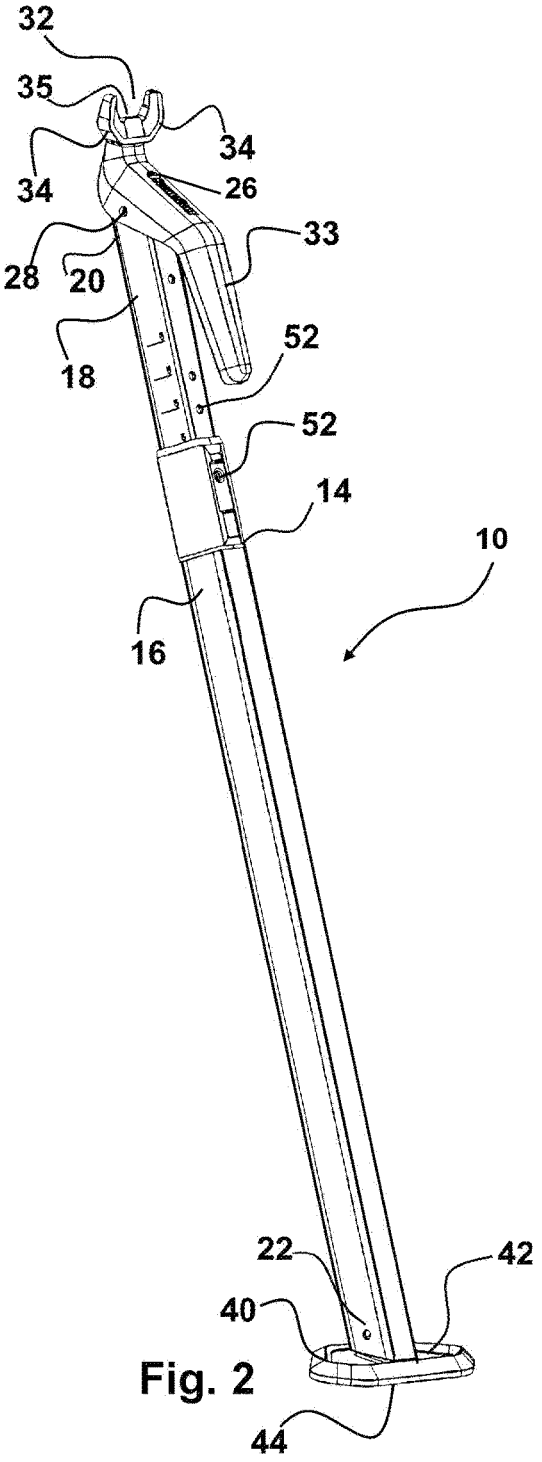
FIG. 2 shows the device of FIG. 1, in a perspective view, showing the first end of the member of the device having a connector adapted to engage around a stem of a projecting doorknob stem.
Figure 2A:
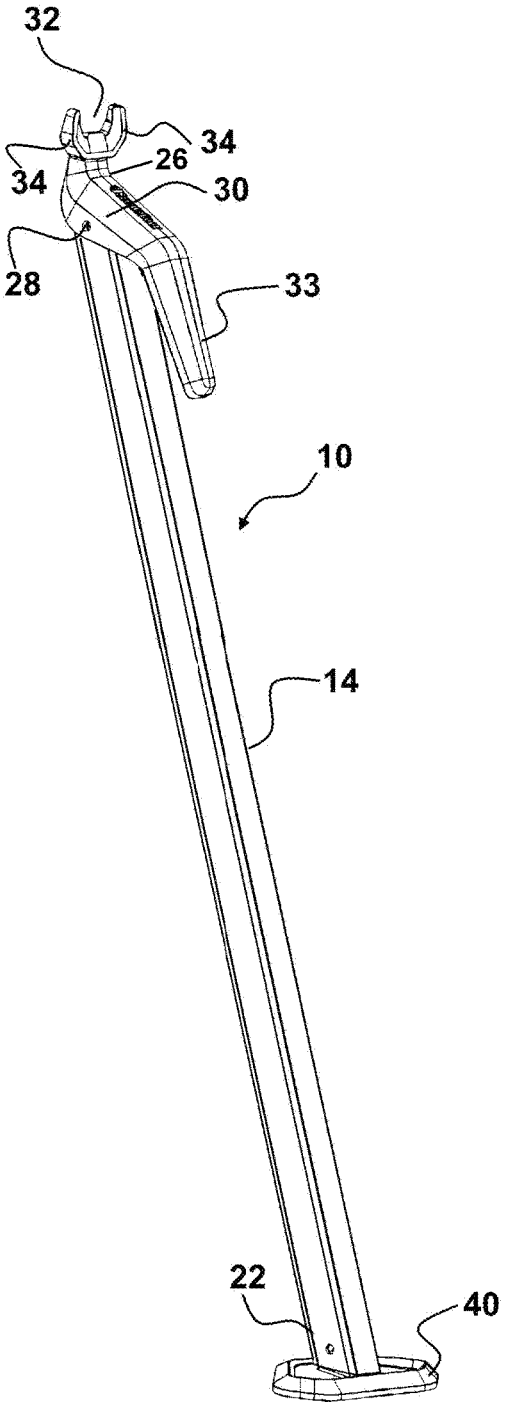

FIG. 2*a* shows a mode of the device having a member of fixed length, which while not as easily packed to a suitcase or the like, will still secure a door from opening.

Figure 1:
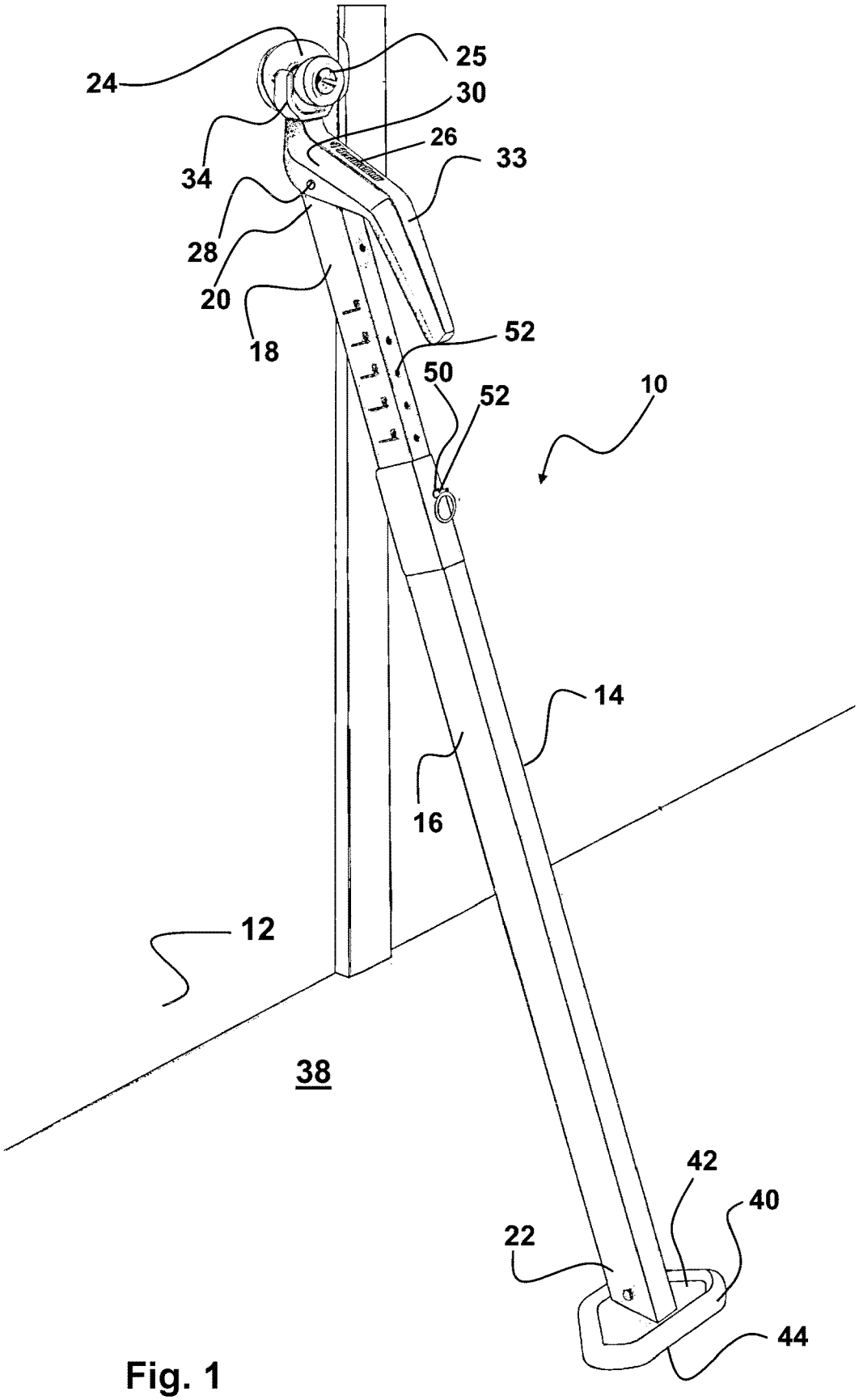
FIG. 1 depicts the door securement device herein, operatively engaged in an as-used position, with a handle of a door engaged with the device at a first end which is in contact with a floor surface at a second end, to prevent opening of the door in a direction toward the engaged device.
Figure 3A:
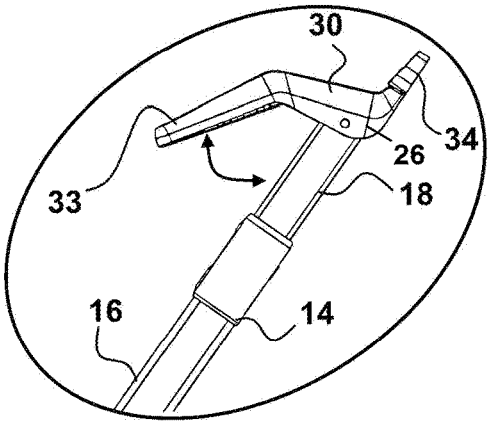
Figure 3:
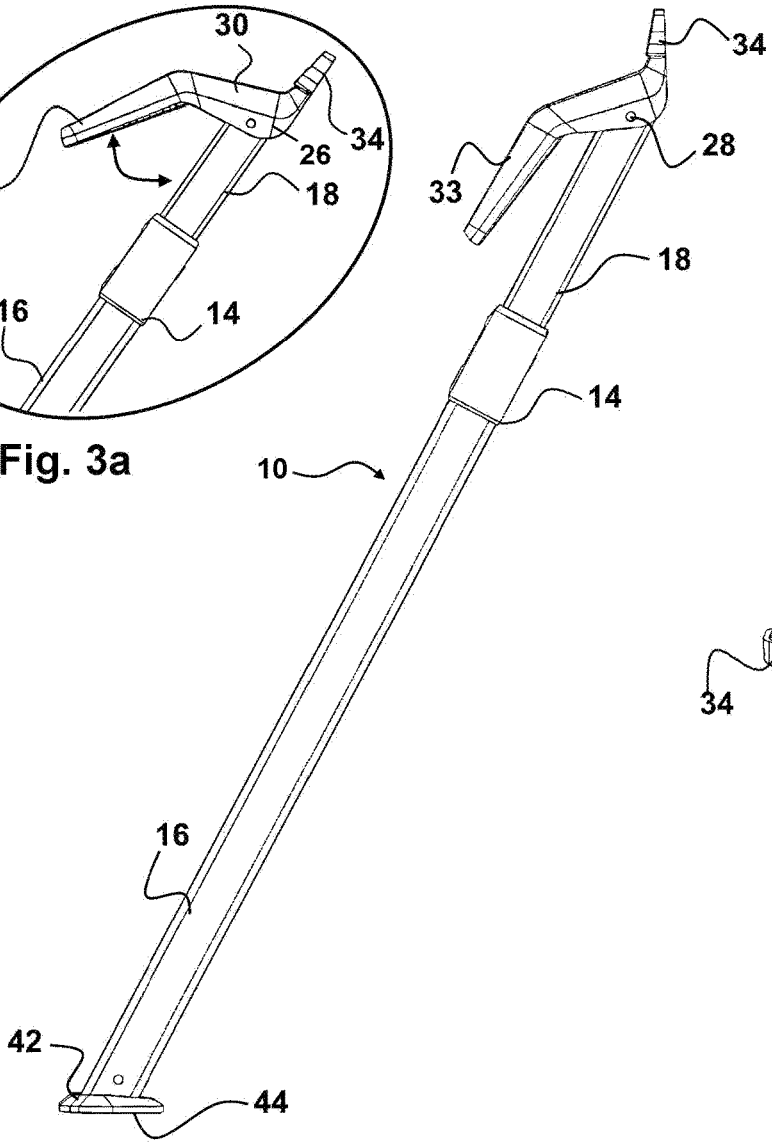

FIG. 3 displays the device from a side view showing the first end of the member having the connector rotated by a handle end, to compressibly engage against a surface of the stem of a doorknob or handle and the handle rotated to the locked position, and showing the connector positioned substantially perpendicular to an imaginary axis running through the center of a doorknob such as in FIG. 1.

FIG. 3*a* shows the device as in FIG. 3, but with the handle of the connector body rotated in a direction away from the member, thereby releasing the connector from the compressed or tensioned engagement against the lower side of a doorknob stem depicted in FIG. 1.

Figure 4:
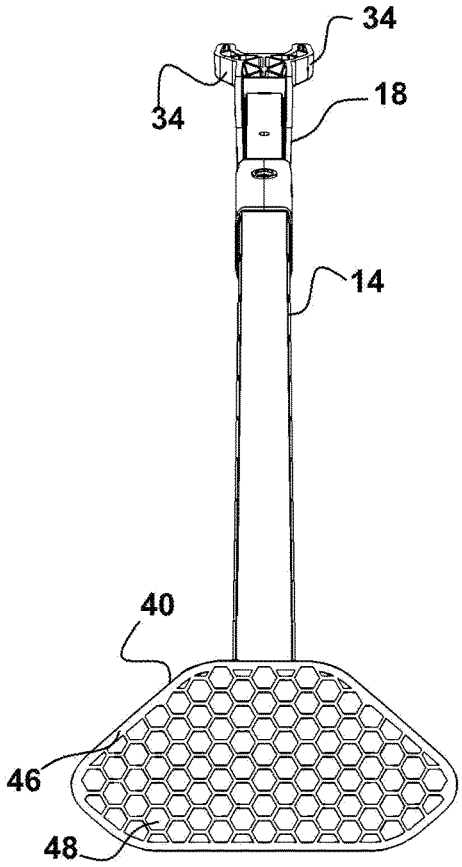

FIG. 4 shows a bottom view of the devices of FIGS. 1-3, showing the bottom surface of an engaged mount, having a gripping interface formed of pliable material with a plurality hexagon shaped cavities depending into the pliable material.

DETAILED DESCRIPTION OF THE INVENTION

The device 10 and system herein disclosed and described in FIGS. 1-4 provide a solution to the shortcomings in prior art of door securement devices. As can be seen in FIG. 1 showing the device 10, in an as-used position, the disclosed door securement device 10 herein, may be easily operatively engaged to prevent opening of a door 12 in a direction toward the device 10.

As shown in FIG. 1, the device 10 has an elongated member 14 which if formed in the preferred telescopically adjustable mode, includes a first member segment 16 which is telescopically engaged with a second member segment 18. While less preferred due to the lack of adjustability and a larger size during transport, the device 10 may also employ a member 14 of fixed length such as shown in FIG. 2*a*.

In all modes of the device 10, a first end 20 of the member 14, is configured to engage with a handle such as with a stem 28 of a door 12 where the handle is used to open a door 12, and a second end of the member 14 is adapted to operatively engage against a floor or support surface 38. In this as-used positioning to hold the door 12 from opening in a direction toward the member 14, an axis running along the member 14 is aligned between this first end engagement with the door knob, and the second end of the member at its engagement with the support surface 38.

While such an engagement of the first end of the member 14 with a door knob may vary, experimentation has found that a connector 26 having a body 30 shaped at a first end to engage against a lower side of the handle stem 28, and positioning two side surfaces of a door handle stem 24 in-between supports or forks 34, to hold a steady connection under force, works best. Currently, a preferred mode of configuring the first end 20 of the telescopic or static member 14 to operatively engage with the stem 24, employs such a connector 26 having a body 30 in a pivoting engagement 28 with the first end 20 of the member 14.

The body 30 of the engaged connector 26 is configured with a slot 32 depending into a first end of the body 30. This slot 30 is positioned between two extending forks 34 extending from the first end of the body 30 of the connector 26. The slot 32 has a width adapted to position interior surfaces 36 of the opposing forks 34 within the slot 32, on opposing sides and immediately adjacent to side surfaces of the stem 24, and concurrently sandwiched in-between the knob 25 which is larger than the slot 32 and the door 12.

This adjacent positioning of the forks 34 to place the stem 24 in a sandwiched positioning therebetween, and position the forks 34 and body 30 of the connector itself, sandwiched engagement between the door 12 and the larger diameter knob 26, is preferred. This is because it has been found in experimentation that such a configuration of forks 34 and positioning between the knob 25 which is wider than the gap 32 and the door 12, secures the connector 26 in a manner such that it is not easily dismounted, by shaking or force against the door 12. Currently, a width of the slot 32 of 34 mm-40 mm in-between facing side surfaces of the forks 34 is preferred and a particularly preferred width is 36 mm to 38 mm as testing and experimentation has shown this width to fit a majority of stems 24 snugly to aid in maintaining a secure engagement if the door 12 is forced.

The pivoting engagement 28 of the body 30 of the connector 26 with the first end of the member 14, is preferably positioned at a mid portion of the body 30 of the connector 26, in between the slot 32 at the first end and a handle 33 at a second end of the body 30 of the connector 26. This handle 33 provides leverage for the body 30 of the connector which is pivotable between a first position where the handle 33 extends at an angle relative to the axis of the member 14 with the distal end of the handle 33 spaced a first distance from the member 14 such as in FIG. 3*a*, to a second position of the body 30 in the pivoting engagement positioning the distal end of the handle 33 at a second distance from the member 14, which is much closer to and adjacent the member 14 such as shown in FIG. 3. In this second position of pivoting of the body 30 in the engagement with the member 14, an interior edge or endwall 35 of the body in-between the two forks 34 contacts a bottom surface or endwall 35 of the stem 24.

This pivoting engagement 28 of the body 30 to the member 14, is preferred in all modes of the device 10 as it allows for a secure compressive engagement of an endwall 35 of the slot 32, opposite the open end between the forks 34, in a compressive contact with the surface of the stem 24, by movement of the handle 33 in a first direction toward the member 14 to the second position shown in FIG. 3. Further, the pivoting engagement 28, in addition to forming this secure compressive engagement, also allows for a quick disengagement by grabbing and movement of the handle 33 in a second direction, to move the body 30 in a pivot back to the first position of FIG. 3*a*, by pulling the handle 33 in a direction moving the distal end of the handle away from the member 14.

In use to engage the device 10 with door 12, the door knob stem 24 is slid into the slot 32 between the two forks 34 at the first end of the body 30 of the connector 26. Then second end 22 of the member 14 which is adapted to be secured against the support surface 38 a distance from the base of the door 12 is so secured. With the member 14 angling from engagement of the connector 26 at the first end 20 with the stem 24 and knob 25, to a contact and engagement against the support surface 38, the door 12 is prevented from opening in a direction toward the engaged device 10. Force against the door 12 will only serve to rotate the connector body 30 in a direction wherein the distal end of the handle is forced toward the member 14.

The second end 22 of the member 14 is preferably adapted for a frictional stationary engagement against the supporting surface 38. While simply placing the second end 22 of the member 14 upon the support surface 38 in the angled positioning of the as-used position of FIG. 1, will secure the device 10 and the door 12, it is preferred that the second end 22 of the member 14 be reinforced in this engagement with a base member 40 to provide additional support to prevent slipping.

A first side 42 of this base member 40 is connected to the second end 22 of the member 14. On a second side 44 of the base member 40, opposite the first side 42, is positioned a contact surface 46 which is formed in a configuration and of a material providing a significant increase in frictional engagement of the base member 40 against the support surface 38.

Currently favored is a contact surface 46 formed of rubber or a polymeric material. In experimentation to determine a material and hardness which is optimum to provide frictional engagement against carpet as well as hardwood, tile, and other support surfaces 38, it was found that polymeric material having a durometer of substantially 65 shore, worked well, and that polymeric material having a durometer of 69-71 shore, worked exceptionally well on all surfaces. Consequently, such is preferred over harder polymeric materials which may wear better over time, but were found to slide more easily.

Additionally preferred, as shown in FIG. 4, is the formation of recesses 48 in a pattern, which depend into the contact surface 46. Various shapes and patterns were tried in experimentation, and it was found that a pattern of a hexagon shaped recesses 48 performed significantly better than other shapes such as rectangles or circular shapes, in preventing slipping of the contact surface 46 and thus the base member 40 and member 14, in differing directions. The hexagon shaped recesses 48 prevented slipping in multiple directions better than other shapes.

Finally, as noted above, the member 14 is preferably telescopic to differing lengths and thereby collapsible from a chosen elongated position to a compact position of the segments for stowing the device 10. In positioning a member 14 formed of at least two segments such as 16 and 18, the user translates the segments 16 and 18 in their sliding telescopic engagement from the compact length to form the member 14 to a desired elongated length which is held by a lock. Such a lock may be any locking engagement as would occur to those skilled in the art. Currently, a preferred lock to fix the engaged first member segment 16 in position with the second member segment 18, is a pin 50 which communicates through openings 52 aligned and formed the sidewalls of both segments of the member 14. Currently, segments 16 and 18, are formed of a respective length, such that when telescopically engaged, the length of the member 14 between the first end 20 to the second end 22, can vary by substantially 370 mm from a longest length to a shortest length. By substantially is meant plus or minus ten percent of the stated figure.

As noted, any of the different configurations and components can be employed with any other configuration or component shown and described as part of the device herein. Additionally, while the present invention has been described herein with reference to particular embodiments thereof and steps in the method of production, a latitude of modifications, various changes and substitutions are intended in the foregoing disclosures, it will be appreciated that in some instance some features, or configurations, or steps in formation of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A portable door securement apparatus comprising:

an elongated member extending along a member axis from a first end of said member to a second end of said member;

a connector, said connector having a body, said body extending from a first end of said connector to a second end of said connector, said body of said connector having a mid portion therebetween;

said first end of said body of said connector adapted for a removable engagement with a doorknob of a door;

said body of said connector having a handle extending from said mid portion thereof, to said second end of said connector;

said second end of said member adapted for a removable engagement with a floor surface;

said mid portion of said body of said connector in a pivoting engagement with and extending across said first end of said member such that said body of said connector is pivotable between a first position and a second position, wherein said handle remains in a fixed relationship with said first end of said body of said connector from said first position to said second position; and wherein with said first end of said connector in said removable engagement with said doorknob and with said second end of said member in said removable engagement with said floor surface, said door is prevented from opening in a direction toward said elongated member.

2. The portable door securement apparatus of claim 1, wherein said first end of said body of said connector is adapted for said removable engagement with a stem of said doorknob with a pair of forks extending from said first end thereof; and a slot positioned in-between said two forks, said slot extending to an opening in-between distal ends of said pair of forks and having an endwall running between said two forks at an opposite end of said slot from said opening, whereby said door stem is positionable to a sandwiched positioning within said slot and in-between said forks by passage thereof through said opening.

3. The portable door securement apparatus of claim 2 additionally comprising:

said distal end of said handle positioned a first distance from a facing exterior surface of said member with said body pivoted to said first position; and said distal end of said handle positioned a second distance from said facing exterior surface of said member, which is smaller than said first distance, with said body of said connector pivoted to said second position.

4. The portable door securement apparatus of claim 3 additionally comprising:

a pivoting of said body of said connector from said first position to said second position adapted to form a compressive contact of said endwall against a lower surface of said stem of said doorknob.

5. The portable door securement apparatus of claim 1 wherein said second end of said member is adapted for removable engagement with said floor surface with a base engaged with said second end of said member;

said base formed of a planar member having a first surface abutting said second end of said member and having a second surface opposite said first surface which is planar and frictionally engageable with said floor surface.

6. The portable door securement apparatus of claim 2 wherein said second end of said member is adapted for removable engagement with said floor surface with a base engaged with said second end of said member;

said base formed of a planar member having a first surface abutting said second end of said member and having a second surface opposite said first surface which is planar and frictionally engageable with said floor surface.

7. The portable door securement apparatus of claim 3 wherein said second end of said member is adapted for removable engagement with said floor surface with a base engaged with said second end of said member;

said base formed of a planar member having a first surface abutting said second end of said member and having a second surface opposite said first surface which is planar and frictionally engageable with said floor surface.

8. The portable door securement apparatus of claim 4 wherein said second end of said member is adapted for removable engagement with said floor surface with a base engaged with said second end of said member;

said base formed of a planar member having a first surface abutting said second end of said member and having a second surface opposite said first surface which is planar and frictionally engageable with said floor surface.

9. The portable door securement apparatus of claim 1 wherein said member is formed of at least a first member segment telescopically engaged with a second member component;

said member having a compact length which is telescopically extendable to an elongated length; and a lock to hold said member to said elongated length.

10. The portable door securement apparatus of claim 2 wherein said member is formed of at least a first member segment telescopically engaged with a second member component;

said member having a compact length which is telescopically extendable to an elongated length; and a lock to hold said member to said elongated length.

11. The portable door securement apparatus of claim 3 wherein said member is formed of at least a first member segment telescopically engaged with a second member component;

said member having a compact length which is telescopically extendable to an elongated length; and a lock to hold said member to said elongated length.

12. The portable door securement apparatus of claim 4 wherein said member is formed of at least a first member segment telescopically engaged with a second member component;

said member having a compact length which is telescopically extendable to an elongated length; and a lock to hold said member to said elongated length.

13. The portable door securement apparatus of claim 5 wherein said member is formed of at least a first member segment telescopically engaged with a second member component;

said member having a compact length which is telescopically extendable to an elongated length; and a lock to hold said member to said elongated length.

14. The portable door securement apparatus of claim 6 wherein said member is formed of at least a first member segment telescopically engaged with a second member component;

said member having a compact length which is telescopically extendable to an elongated length; and a lock to hold said member to said elongated length.

15. The portable door securement apparatus of claim 7 wherein said member is formed of at least a first member segment telescopically engaged with a second member component;

said member having a compact length which is telescopically extendable to an elongated length; and a lock to hold said member to said elongated length.

16. The portable door securement apparatus of claim 8 wherein said member is formed of at least a first member segment telescopically engaged with a second member component;

said member having a compact length which is telescopically extendable to an elongated length; and a lock to hold said member to said elongated length.

17. The portable door securement apparatus of claim 2 wherein said slot has a width running between opposing facing side surfaces of said forks, said width being between 36 mm to 38 mm.

18. The portable door securement apparatus of claim 4 wherein said slot has a width running between opposing facing side surfaces of said forks, said width being between 36 mm to 38 mm.

19. The portable door securement apparatus of claim 5 wherein said slot has a width running between opposing facing side surfaces of said forks, said width being between 36 mm to 38 mm.

20. The portable door securement apparatus of claim 1, wherein in said first position said first end of said body of said connector is aligned with the member axis and in said second position said first end of said body of said connector is offset from the member axis.

* * * * *